US008243112B2

(12) United States Patent
Shintani et al.

(10) Patent No.: US 8,243,112 B2
(45) Date of Patent: Aug. 14, 2012

(54) RECORDING HEAD AND RECORDING APPARATUS PROVIDED WITH THE RECORDING HEAD

(75) Inventors: Shigetaka Shintani, Kirishima (JP); Takashi Aso, Kirishima (JP)

(73) Assignee: Kyocera Corporation, Kyoto (JP)

( * ) Notice: Subject to any disclaimer, the term of this patent is extended or adjusted under 35 U.S.C. 154(b) by 27 days.

(21) Appl. No.: 12/596,144

(22) PCT Filed: Mar. 27, 2008

(86) PCT No.: PCT/JP2008/055966

§ 371 (c)(1),
(2), (4) Date: Jun. 7, 2010

(87) PCT Pub. No.: WO2008/123382

PCT Pub. Date: Oct. 16, 2008

(65) Prior Publication Data

US 2011/0141215 A1 Jun. 16, 2011

(30) Foreign Application Priority Data

Mar. 28, 2007 (JP) ..... 2007-084210

(51) Int. Cl.
*B41J 2/335* (2006.01)
*B41J 2/345* (2006.01)

(52) U.S. Cl. ..... 347/208

(58) Field of Classification Search ..... 347/200, 347/208

See application file for complete search history.

(56) References Cited

FOREIGN PATENT DOCUMENTS

| | | |
|---|---|---|
| JP | 01-141064 | * 6/1989 |
| JP | 02-137945 | * 5/1990 |
| JP | 05-270034 | * 10/1993 |
| JP | 2008-238668 | * 10/2008 |

* cited by examiner

*Primary Examiner* — Huan Tran

(74) *Attorney, Agent, or Firm* — Birch, Stewart, Kolasch & Birch, LLP

(57) ABSTRACT

The present invention provides a recording head for a photographic printing device. The recording head of the present invention includes on a substrate two heating elements arranged adjacently and parallel to each other on a substrate. Each of the heating elements has connected to its ends a connection section, the connection sections and the heating element lying in a straight line. First and second connection sections are connected to the first heating element and third and fourth connection sections are connected to the second heating element. The heat capacities of the first and fourth connection sections are different from that of the second and of the third connection sections. The heat capacities of the first and fourth connection sections are substantially the same, as are the heat capacities of the second and third connection sections.

16 Claims, 13 Drawing Sheets

RECORDING HEAD AND RECORDING APPARATUS PROVIDED WITH THE RECORDING HEAD

CROSS-REFERENCE TO RELATED APPLICATION

The present application is the United States national stage application of international application serial number PCT/JP2008/055966, filed 27 Mar. 2008, which claims priority to Japanese patent application no. 2007-084210, filed 28 Mar. 2007, which is incorporated herein by reference in its entirety.

FIELD

Embodiments of the present invention relate generally to recording heads, and more particularly relate to a recording head for a photographic printing device.

BACKGROUND

A thermal head has a plurality of resistance heating elements arranged on a substrate and first and second electrodes connected to the plurality of resistance heating elements. The thermal head prints, by heating the plurality of resistance heating elements, on a recording medium such as a heat-sensitive sheet in accordance with a signal. The plurality of resistance heating elements is heated by providing electric power to the plurality of resistance heating elements via the first and second electrodes.

One of the plurality of resistance heating elements is configured such that a connection end connecting with a first electrode has a smaller width than a connection end connecting with a second electrode, and another resistance heating element adjoining the one of the plurality of resistance heating elements is configured such that a connection end connecting with the first electrode has a larger width than a connection end connecting with the second electrode.

For each resistance heating element, the amount of heat generated on the first electrode side and the amount of heat generated on the second electrode side are different. Further, in this thermal head, an area of the first electrode in contact with the connection end and an area of the second electrode in contact with the connection end are different in accordance with the width of the connection end. Then, for example, when continuously applying current, for example, during actual printing, a larger amount of heat is accumulated in the electrode for the connection end having a smaller width, and accordingly, a position of transferred dot is displaced with respect to a position at an initial position toward the electrode for the connection end having the smaller width. Therefore, in this thermal head, the distance between a transferred dot made by one of the plurality of resistance heating elements and a transferred dot made by another resistance heating element adjacent to the one of the plurality of resistance heating elements in a direction in which the plurality of resistance heating elements are arranged. As a result, a quality of an image obtained by this thermal head is degraded due to a large amount of heat accumulated in proximity to each resistance heating element.

SUMMARY

An embodiment of the present invention comprises a recording head. The recording head comprises a substrate, a first heating unit on the substrate, and a second heating unit on the substrate. The first heating unit comprises a first heating element, a first connection section and a second connection section. The first heating element comprises a first end and a second end. The first connection section is connected to the first end and the second connection section is connected to the second end. The second heating unit is adjacent to the first heating element in parallel to the first heating unit and comprises a second heating element, a third connection section and fourth connection section. The second heating element comprises a third end and a fourth end. The third connection section is connected to the third end and the fourth connection section is connected to the fourth end. The first heating element, the first connection section and the second connection section lie in a strait line. The first connection section has a different heat capacity from the third connection section and/or the second connection section has a different heat capacity from the fourth connection section.

An embodiment of the present invention comprises a recording head. The recording head comprises a substrate, a first heating unit on the substrate and a second heating unit on the substrate. The first heating unit comprises a first heating element, a first connection section and a second connection section. The first heating element comprises a first end and a second end. The first connection section is connected to the first end and the second connection section is connected to the second end. The second heating unit is adjacent to the first heating element in parallel to the first heating unit and comprises a second heating element, a third connection section and fourth connection section. The second heating element comprises a third end and a fourth end. The third connection section is connected to the third end and the fourth connection section is connected to the fourth end. The first heating element, the first connection section and the second connection section lie in a strait line. The first connection section has a different volume from the third connection section and/or the second connection section has a different volume from the fourth connection section.

An embodiment of the present invention comprises a recording apparatus. The recording apparatus comprises one of the above mentioned recording heads and a conveyance unit which is configured to convey a recording medium above the recording head.

BRIEF DESCRIPTION OF DRAWINGS

Embodiments of the present invention are hereinafter described in conjunction with the following figures, wherein like numerals denote like elements. The figures are provided for illustration and depict exemplary embodiments of the invention. The figures are provided to facilitate understanding of the embodiments without limiting the breadth, scope, scale, or applicability of the invention. The drawings are not necessarily made to scale.

DETAILED DESCRIPTION

Certain embodiments as disclosed herein provide for a thermal head and a method for manufacturing the acceleration sensor. After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Embodiments of the present invention are described herein in the context of one practical non-limiting application, namely, a thermal head. Embodiments of the present invention, however, are not limited to such recording head applications such as thermal head printers, and the like, and the techniques described herein may also be utilized in other applications of recording head. For example, embodiments may be applicable to photographic printing devices such as facsimile machines, barcode printers, video printers, digital photo printers, and the like.

Figure 1:
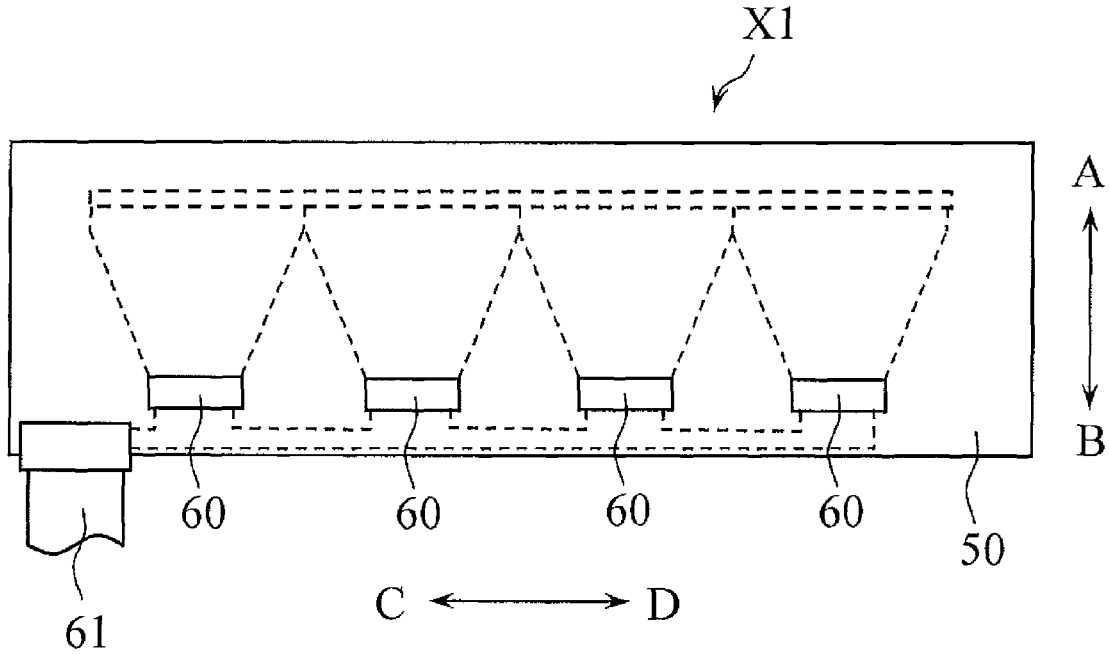
FIG. 1 is a plan view schematically illustrating a thermal head according to an embodiment of the present invention.
Figure 2:
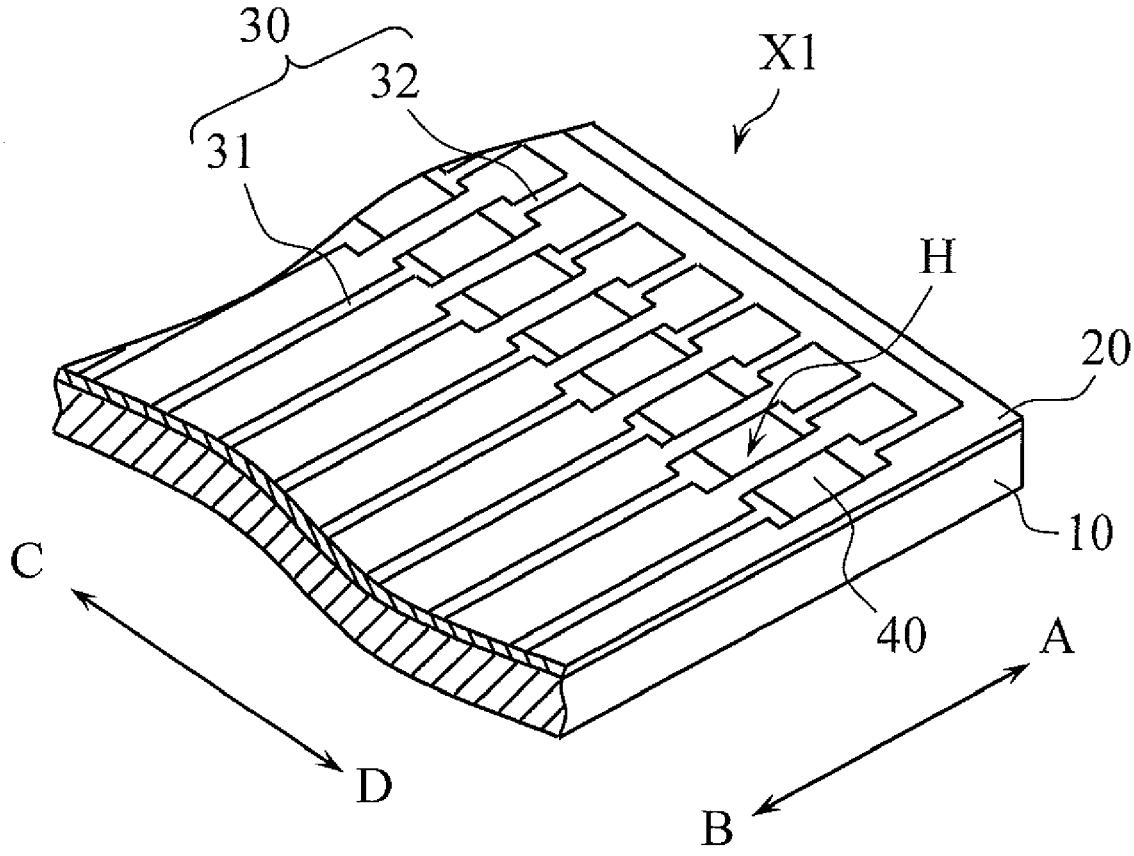
FIG. 2 is an enlarged perspective view illustrating a part of the thermal head shown in FIG. 1.

FIG. 1 is a plan view schematically illustrating a thermal head according to an embodiment of the present invention. FIG. 2 is an enlarged perspective view illustrating a part of the thermal head shown in FIG. 1. A thermal head X1 shown in FIG. 1 and FIG. 2 comprises a substrate 10, a heat accumulation layer 20, a conductive layer 30, a resistive layer 40, a protective layer 50, and a driving IC 60. This thermal head X1 further comprises an external connection member 61. This thermal head X1 is configured such that a print signal is provided from the outside to the driving IC 60 via this external connection member 61. Examples of this external connection member 61 comprise a flexible printed circuit and a wiring board. In FIG. 2, the protective layer 50 is not given for easily understanding the figure.

The substrate 10 has a function to support the heat accumulation layer 20, the conductive layer 30, the resistive layer 40, the protective layer 50, and the driving IC 60. The substrate 10 is adopted to have a rectangular shape in plan view. Examples of a material constituting the substrate 10 may be an electrical insulation material. The insulation material is referred to herein as a material in which no current substantially flow, such as a material having a resistivity of $1.0\times10^{14}$ Ω·cm or more. Examples of the electrical insulation material comprise ceramics such as alumina ceramics (thermal conductivity: approximately 25 W/m·K), resin materials such as epoxy resin and silicone resin, silicone material, and glass material. A material constituted by alumina ceramics is used as the substrate 10 in the present embodiment.

The heat accumulation layer 20 is adapted to temporarily accumulate a portion of heat generated by a later-described heating element H of the resistive layer 40. Namely, the heat accumulation layer 20 plays a role of improving a thermal response property of the thermal head X1 by shortening a time needed to increase the temperature of the heating element H. The heat accumulation layer 20 is arranged on the substrate 10, and is configured to have a substantially same thickness on all over the upper surface of the substrate 10. "Substantially flat" means that, for example, an error of thickness with respect to a mean value is less than 10%. An arithmetic-geometric mean is used as the "mean value." Examples of a material constituting the heat accumulation layer 20 comprise a material having a small thermal conductivity than the substrate. Since the substrate 10 is constituted by alumina ceramics according to the present embodiment, examples of the heat accumulation layer 20 comprise glass materials (heat conductivity: approximately 0.99 W/m·K) and resin materials such as epoxy resin and polyimide resin. Among these materials, the glass materials are preferable in terms of a heat resistance property.

Figure 3:
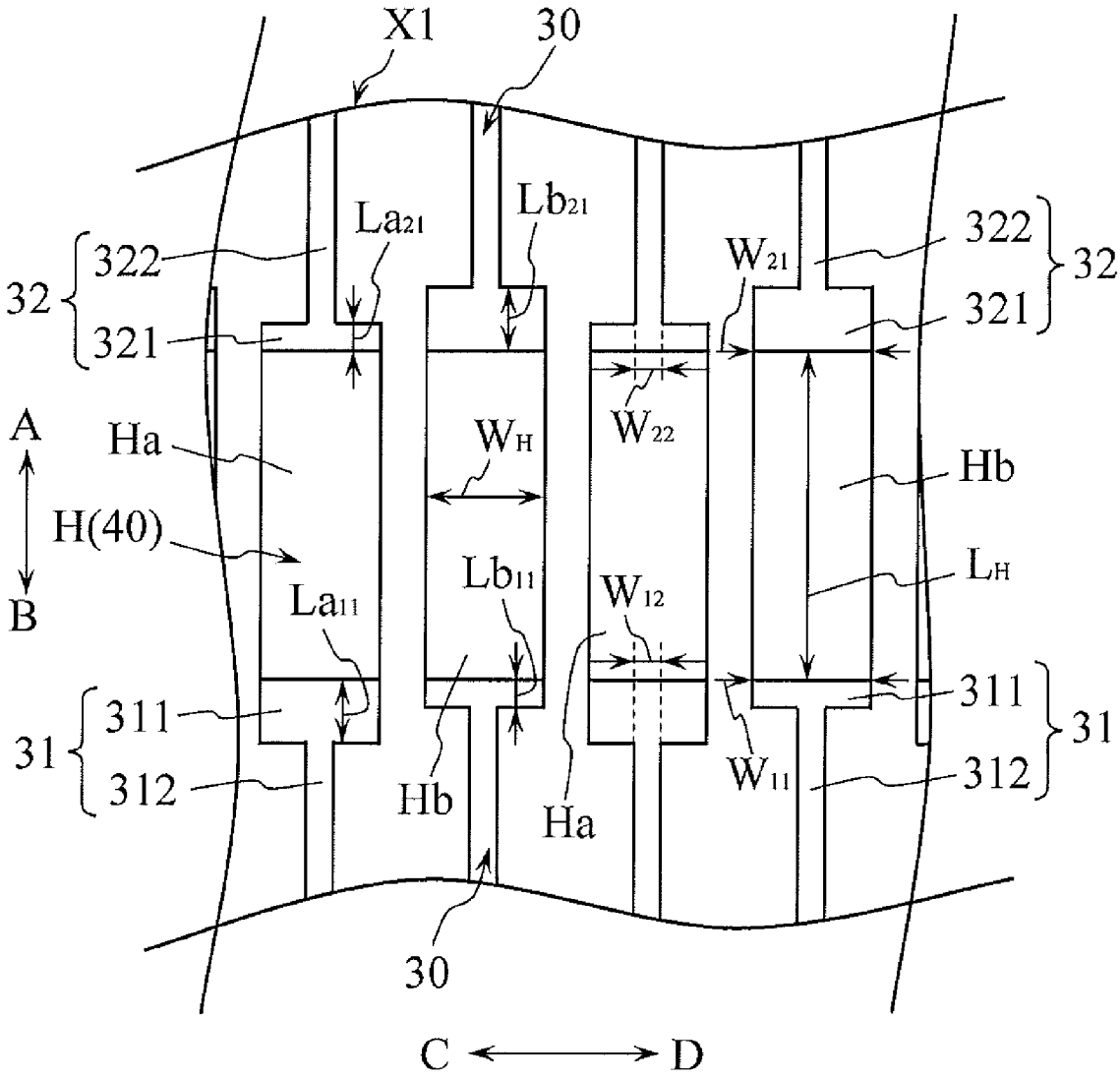
FIG. 3 is an enlarged plan view illustrating a part of the thermal head shown in FIG. 2.

The conductive layer 30 shown in FIG. 3 is adapted to apply a predetermined voltage to the heating element H of the later-described resistive layer 40. The conductive layer 30 is configured to comprise a first electrode 31 and a second electrode 32. This conductive layer 30 is arranged above the heat accumulation layer 20. Examples of a material constituting the conductive layer 30 comprises aluminum, aluminum alloy, copper, copper alloy, gold, and silver. Among these materials, aluminum and aluminum alloy are preferable in terms of oxidation stability. For example, the thickness of this conductive layer 30 may be in a range between 0.1 μm and 2.0 μm. When the conductive layer 30 is configured to have a thickness in this range, the resistance value of the conductive layer can be decreased, and the later-described heating element H and a recording medium P can be brought into good contact with each other.

The first electrode 31 is configured to comprise a first connection section 311 and a first conductive section 312, which are an essential portion. One end of the first connection section 311 is connected to one end of the heating element H indicated by the direction of arrow B, and the other end of the first connection section 311 is connected to one end of the first conductive section 312. This first connection section 311 is located on the heat accumulation layer 20. The one end of the first conductive section 312 is connected to the other end of the first connection section 311, and the other end of the first conductive section 312 is connected to the driving IC 60. A portion of the one end of the first conductive section 312 is located on the heat accumulation layer 20.

The second electrode 32 is configured to comprise a second connection section 321 and a second conductive section 322, which are an essential portion. One end of the second connection section 321 is connected to the other end of the heating element H indicated by arrow A, and the other end of the second connection section 321 is connected to one end of the second conductive section 322. Further, a plan view width $W_{21}$ of the one end of the second connection section 321 (a connection end connected to the heating element H) is configured to be substantially the same as a plan view width $W_{11}$ of the one end of the first connection section 311 (a connection end connected to the heating element H). This second connection section 321 is located on the heat accumulation layer 20. The second conductive section 322 is connected to the other end of the second connection section 321 and a power supply which is not shown in Figures. A plan view width $W_{22}$ of the one end of this second conductive section 322 (a connection end connected to the second connection section 321) is configured to be substantially the same as a plan view width $W_{12}$ of the one end of the first conductive section 312 (a connection end connected to the first connection section 311). Further, the plan view width $W_{22}$ of this second conductive section 322 is configured to be smaller than the plan view width $W_{21}$ of the second connection section 321. Further, a portion of the one end of this second conductive section 322 is located on the heat accumulation layer 20. Herein, "substantially the same" means including those within a generally-occurring manufacturing error, such as one in which an error of each width with respect to the mean value is within a range of 10[%].

The resistive layer 40 is electrically connected to the conductive layer 30, and a portion of the resistive layer 40 applied with the voltage by the conductive layer 30 serves as the heating element H. Examples of a material constituting the resistive layer 40 comprise a conductive material having a resistivity larger than the conductive layer 30. Examples of such conductive materials comprise TaN materials, TaSiO materials, TiSiO materials, TiCSiO materials, and NbSiO materials. Among these, the TaSiO materials are preferable in terms of stability in resistance value such as tolerance to pulse. The thickness of this resistive layer 40 is configured to be substantially the same in the entire resistive layer 40. The thickness of the resistive layer 40 is, for example, within a range between 0.01 [μm] and 1.0 [μm]. The thickness of the resistive layer 40 is configured to be within this range, so that the resistance value of the resistive layer 40 is increased to an appropriate degree, and a tolerance to heat stress can be improved. Herein, "substantially the same" means including those within a generally-occurring manufacturing error, such as one in which an error of each width with respect to the mean value is within a range of 10[%].

The heating element H generates heat by electricity provided via the conductive layer 30. The heating element H is configured such that the temperature of the heating element H heated by the electricity provided via the conductive layer 30 is, for example, within a range between 200 [C.°] and 450 [C.°]. This heating element H is located on the heat accumulation layer 20, and the plurality of heating elements H are located in a main scanning direction (direction of arrow CD) crossing a conveyance direction of a recording medium (direction of arrow AB). In the present embodiment, the resistive layer 40 between the first connection section 311 of the first electrode 31 and the second connection section 321 of the second electrode 32 serves as the heating element H. Each of the heating elements H is formed in a rectangular shape in plan view. In each of the heating elements H, a connection end section connected to the first connection section 311 of the first electrode 31 and a connection end section connected to the second connection section 321 of the second electrode 32 are located along the direction of arrow CD (direction in which the plurality of heating elements H are arranged). In the heating element H, the connection end section connected to the first connection section 311 and the connection end section connected to the second connection section 321 are respectively arranged in line in the direction of arrow CD. In each of the heating elements H, both ends in the main scanning direction (direction of arrow CD) are arranged along the sub-scanning direction (direction of arrow AB) crossing the main scanning direction. The heating element H is configured such that a plan view length $L_H$ is substantially the same as the plan view width $W_H$. For example, this plan view length $L_H$ may be in a range between 95 [μm] and 175 [μm]. For example, this plan view width $W_H$ may be in a range between 60 [μm] and 76 [μm]. Herein, "substantially the same" means including those within a generally-occurring manufacturing error, such as one in which an error of each width with respect to the mean value is within a range of 10[%].

The structures of the conductive layer 30 and the resistive layer 40 according to the present embodiment is described further in detail with reference to FIG. 3.

In the present embodiment, the plurality of heating elements H comprises the first heating elements Ha and the second heating elements Hb. Further, the first heating elements Ha and the second heating elements Hb are arranged alternately. In the plurality of heating elements H, a heat capacity of the first connection section 311 connected to the first heating element Ha is configured to be larger than a heat capacity of the second connection section 321 connected to the first heating element Ha. A heat capacity of the first connection section 311 connected to the second heating element Hb is configured to be smaller than a heat capacity of the second connection section 321 connected to the second heating element Hb. A heat capacity of the first connection section 311 connected to the first heating element Ha is substantially the same as a heat capacity of the second connection section 321 connected to the second heating element Hb. A heat capacity of the second connection section 321 connected to the first heating element Ha is substantially the same as a heat capacity of the first connection section 311 connected to the second heating element Hb. Herein, "heat capacity" means constant volume heat capacity. This "constant volume heat capacity" means the amount of heat needed to change the temperature of a substance by a unit temperature where the substance is kept at a constant volume, and is represented by, for example, a unit of [J/K].

In the present embodiment, plan view lengths $La_{11}$ and $Lb_{11}$ of the first connection section 311 and plan view lengths $La_{21}$ and $Lb_{21}$ of the second connection section 321 are, for example, within a range between zero and the plan view length $L_H$ of the heating element H. When the plan view lengths $La_{11}$, $La_{21}$, $Lb_{11}$ and $Lb_{21}$ of the connection sections 311,321 are configured to be less than the plan view length $L_H$ of the heating element H, differences among the thermal capacities can be configured preferably. In order to preferably displace a position of a heat spot, the plan view lengths $La_{11}$, $La_{21}$, $Lb_{11}$ and $Lb_{21}$ are preferably configured to be, for example, within a range between 10 [μm] and 30 [μm].

The protective layer 50 is adapted to protect the conductive layer 30 and the resistive layer 40. Examples of a material constituting the protective layer 50 comprise an insulation material. Examples of this insulation material comprise Si—N inorganic materials such as silicon nitride ($Si_3N_4$), Si—N—O inorganic materials such as sialon (SiAlON), and Si—C inorganic materials. Among these materials, Si—N and Si—N—O inorganic materials are preferable in terms of a close contact property and a sealing property. Further, Si—C inorganic materials are preferable in terms of hardness. It should be noted that the protective layer 50 is not given from FIG. 3 for easily understanding the figure.

The driving IC 60 is adapted to control ON/OFF state of the voltage applied to each of the heating elements H. In other words, this driving IC 60 plays a role of selecting one of the plurality of heating elements H to generate heat. The heating element H is selected based on the print signal input via the external connection member 61. This driving IC 60 is electrically connected to the other end of the first conductive section 312 of the first electrode 31. The driving IC 60 and the first electrode 31 are connected via a conductive connection material such as soldering and a bonding wire which are not shown. In the present embodiment, the driving IC 60 and the first electrode 31 are connected via the conductive connection material at the other end of the first conductive section 312, so that a less amount of heat generated by the driving IC 60 and a less amount of heat generated by the heating element H move via the first electrode 31.

In the thermal head X1, the heat capacity of the first connection section 311 connected to the first heating element Ha is larger than the heat capacity of the second connection section 321 connected to the first heating element Ha. Further, in the thermal head X1, the heat capacity of the first connection section 311 connected to the second heating element Hb is smaller than the heat capacity of the second connection section 321 connected to the second heating element Hb. Therefore, when a large amount of heat is accumulated in proximity to each of the heating elements H, for example, when continuously applying current, the thermal head X1 can use a difference of the amounts of transmitted heat based on a difference of thermal capacities between the first connection section 311 and the second connection section 321 so as to displace the position of the heat spot from the position at the initial power-on (near the center of the heating element H). In other words, when a large amount of heat is accumulated in proximity to each of the heating elements H, for example, when continuously applying current, the thermal head X1 can reduce the effect of heat transmitted between the heating elements Ha and Hb adjoining each other. Therefore, the thermal head X1 can reduce unevenness in the amounts of accumulated heat between a central portion and both end portions in a group of heating units constituted by the plurality of heating elements H. Therefore, the thermal head X1 can reduce unevenness in the image between the central portion and the both end portions of the group of heating units.

In the thermal head X1, the heat capacity of the first connection section 311 connected to the first heating element Ha is substantially the same as the heat capacity of the second connection section 321 connected to the second heating element Hb. The heat capacity of the second connection section 321 connected to the first heating element Ha is substantially the same as the heat capacity of the first connection section 311 connected to the second heating element Hb. Therefore, in the thermal head X1, the amount of heat generated by each of the heating elements H and moving to the first electrode 31 can be made almost the same as the amount of heat generated thereby and moving to the second electrode 32. Therefore, the thermal head X1 can improve the quality of image.

In the thermal head X1, the connection end of the heating element H connected to the first connection section 311 and the connection end of the heating element H connected to the second connection section 321 have substantially the same cross sectional area taken along the direction in which the plurality of heating elements H are arranged (direction of arrow CD). Therefore, in the thermal head X1, the amount of heat moving from the heating element H to the first connection section 311 can be made almost the same as the amount of heat moving therefrom to the second connection section 321. Therefore, the thermal head X1 can improve the quality of image.

In the thermal head X1, the cross sectional area taken along the direction in which the plurality of heating elements H are arranged (direction of arrow CD) is substantially the same at any point between the connection end section of the heating element H connected to the first connection section 311 and the connection end section of the heating element H connected to the second connection section 321. Therefore, even when the position of the heat spot of each of the heating elements H is displaced from the position at the initial power-on (near the center of the heating element H) toward the first electrode 31 or the second electrode 32 by continuously energizing the plurality of heating elements H, the thermal head X1 does not substantially change the spacing distance, in the direction of arrow CD, between the heat spot of the first heating element Ha and the heat spot of the second heating element Hb, for example. Consequently, the thermal head X1 can reduce deterioration of image quality caused by the change in the spacing distance between the heat spots of the heating elements H, thus improving image quality.

Further, the plurality of heating elements H in the thermal head X1 are configured such that the connection end section connected to the first electrode 31 and the connection end section connected to the second electrode 32 are formed along the direction of arrow CD. Therefore, in the thermal head X1, the position of the heat spot of each of the heating elements H is not displaced from the position at the initial power-on, and the heat transmitted between the heating element Ha and Hb adjoining each other can be effectively used. Therefore, the thermal head X1 can improve the thermal response, when a small amount of heat is accumulated in proximity to each of the heating elements H, for example, at the initial power-on.

In the thermal head X1, the plan view width $W_{12}$ of the first conductive section 312 is less than the plan view width $W_{11}$ of the first connection section 311. Therefore, even when, for example, the plan view width of the driving IC 60 in the direction of arrow CD is less than the plan view width of an area formed with the first conductive section 312 connected to the driving IC 60, the effect caused by the difference of thermal capacities can be reduced in an area in which wirings are located.

In the thermal head X1, the plan view width $W_{12}$ of the first conductive section 312 is less than the plan view width $W_{11}$ of the first connection section 311, and the plan view width $W_{22}$ of the second conductive section 322 is less than the plan view width $W_{21}$ of the second connection section 321. Therefore, the thermal head X1 can preferably accumulate the heat generated by the heating element H. Further, even when, for example, the plurality of second connection sections 321 are connected to a common connection pattern extending in the main scanning direction, the thermal head X1 can reduce the heat moving via the common connection pattern. Accordingly, even when, for example, the heat capacity of the first connection section 311 is less than the heat capacity of the common connection pattern, the thermal head X1 can preferably displace the position of the heat spot.

In the thermal head X1, a portion of the one end of the first connection section 311 and a portion of the one end of the second connection section 321 are located on the heat accumulation layer 20, and therefore, a less amount of heat generated by the heating element H moves to the substrate 10. Therefore, the thermal head X1 can preferably displace the position of the heat spot.

Figure 4:
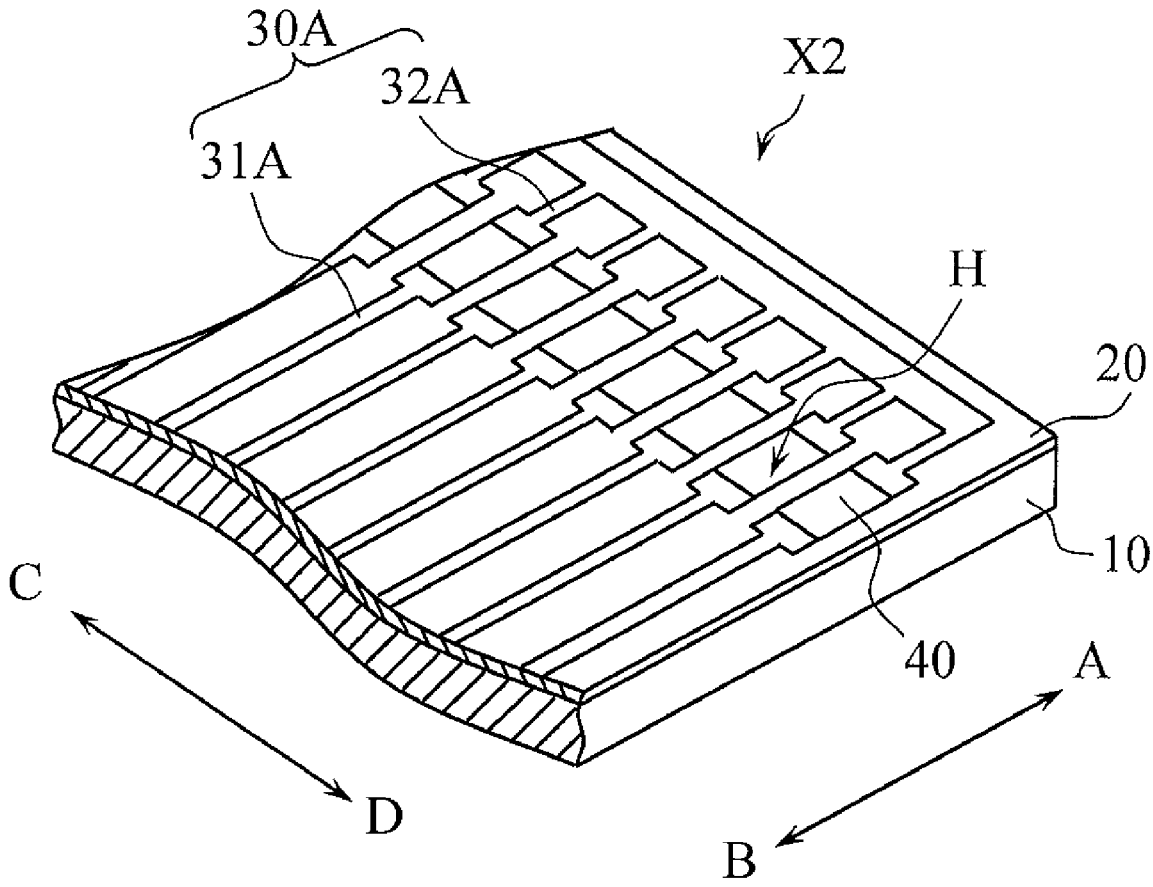
FIG. 4 is an enlarged perspective view schematically illustrating a configuration of a thermal head according to an embodiment of the present invention.

FIG. 4 is an enlarged perspective view schematically illustrating a configuration of a thermal head according to an embodiment of the present invention. A thermal head X2 shown in FIG. 4 is different from the thermal head X1 in that a conductive layer 30A is employed instead of the conductive layer 30. The thermal head X2 is configured to be the same as the above-described thermal head X1 except for the above difference.

Figure 5:
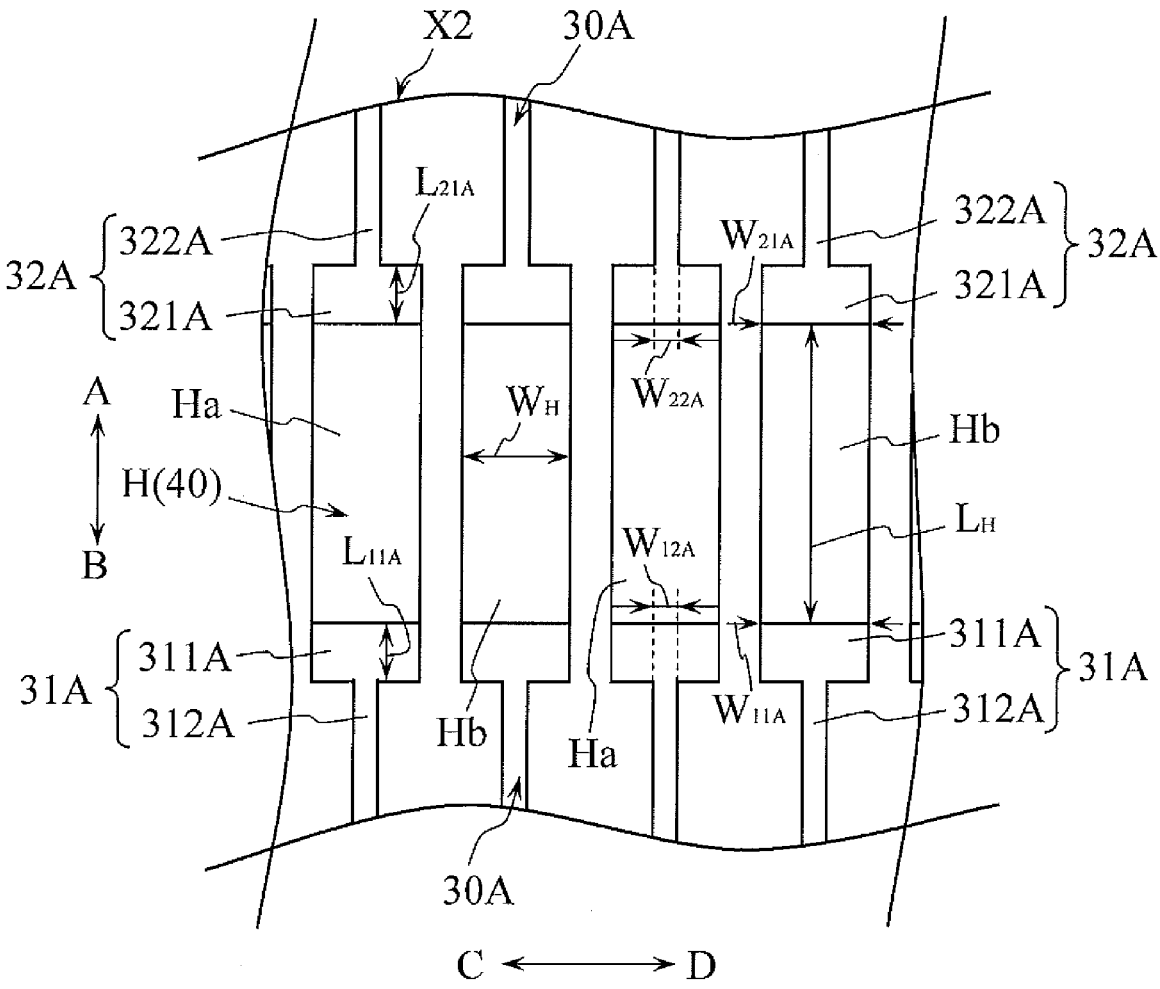
FIG. 5 is an enlarged plan view illustrating a part of the thermal head shown in FIG. 4.

The conductive layer 30A shown in FIG. 5 is different from the conductive layer 30 in that a first electrode 31A is employed instead of the first electrode 31 and a second electrode 32A is employed instead of the second electrode 32. The conductive layer 30A is configured to be the same as the above-described conductive layer 30 except for the above difference.

The first electrode 31A comprises a first connection section 311A and a first conductive section 312A, which are an essential portion. One end of the first connection section 311A is connected to one end of the heating element H indicated by the direction of arrow B, and the other end of the first connection section 311A is connected to one end of the first conductive section 312A. This first connection section 311A is located on the heat accumulation layer 20. The plan view length $L_{11A}$ of this first connection section 311A is, for example, within a range between zero and the plan view length $L_H$ of the heating element H. The one end of the first conductive section 312A is connected to the other end of the first connection section 311A, and the other end of the first conductive section 312A is connected to the driving IC 60. A portion of the one end of this first conductive section 312A is located on the heat accumulation layer 20.

The second electrode 32A comprises a second connection section 321A and a second conductive section 322A, which are an essential portion. One end of the second connection section 321A is connected to the other end of the heating element H indicated by the direction of arrow A, and the other end of the second connection section 321A is connected to one end of the second conductive section 322A. A plan view width $W_{21A}$ of the one end of this second connection section 321A (a connection end connected to the heating element H) is configured to be substantially the same as a plan view width $W_{11A}$ of the one end of the first connection section 311A (a connection end connected to the heating element H). This second connection section 321A is located on the heat accumulation layer 20. A plan view length $L_{21A}$ of this second connection section 321A is configured to be substantially the same as the plan view length $L_{11A}$ of the first connection section 311A. The plan view length $L_{1\ 1A}$ of this second connection section 311A is, for example, within a range between zero and the plan view length $L_H$ of the heating element H. Further, the thickness of this second connection section 321A is different from the thickness of the first connection section 311A. The second conductive section 322A is connected to the other end of the second connection section 321A and the power supply which is not shown. A plan view width $W_{22A}$ of the one end of this second conductive section 322A (a connection end connected to the second connection section 321A) is configured to be the same as a plan view width $W_{12A}$ of the one end of the first conductive section 312A (a connection end connected to the first connection section 311A). The plan view width $W_{22A}$ of this second conductive section 322A is configured to be less than the plan view width $W_{21A}$ of the second connection section 321A. Further, a portion of the one end of this second conductive section 322A is located on the heat accumulation layer 20. Herein, "substantially the same" means including those within a generally-occurring manufacturing error, such as one in which an error of each width with respect to the mean value is within a range of 10[%].

In the present embodiment, a specific heat of a material constituting the second electrode 32A is substantially the same as a specific heat of a material constituting the first electrode 31A. In the present embodiment, the materials having substantially the same specific heat are used as described above, so that the first electrode 31A and the second electrode 32A can be designed more easily. The material constituting the second electrode 32A is preferably the same as the material constituting the first electrode 31A, because the amount of heat generated by each of the heating elements H and moving to the first electrode 31A is to be almost the same as the amount of heat generated thereby and moving to the second electrode 32A. The thermal head X2 configured as described above can improve image quality. Further, in the thermal head X2 configured as described above, for example, the first electrode 31A and the second electrode 32A can be formed in the same step, and accordingly, the efficiency in the manufacture can be improved. Herein, "specific heat" means constant volume specific heat. This "constant volume specific heat" means the amount of heat needed to change the temperature of a substance per unit quantity by a unit temperature where the substance is kept at a constant volume, and is represented by, for example, a unit of [J/m$^3$·K]. Examples of a method for measuring this "specific heat" comprise differential thermal analysis (DTA) and differential scanning calorimetry (DSC).

Further, in the present embodiment, the thickness of the first connection section 311A connected to the first heating element Ha is configured to be more than the thickness of the second connection section 321A connected to the first heating element Ha. The thickness of the first connection section 311A connected to the second heating element Hb is configured to be less than the thickness of the second connection section 321A connected to the second heating element Hb. The thickness of the first connection section 311A connected to the first heating element Ha is configured to be substantially the same as the thickness of the second connection section 321A connected to the second heating element Hb. The thickness of the second connection section 321A connected to the first heating element Ha is substantially the same as the thickness of the first connection section 311A connected to the second heating element Hb. Therefore, in the present embodiment, the volume of the first connection section 311A connected to the first heating element Ha is configured to be more than the volume of the second connection section 321A connected to the first heating element Ha. The volume of the first connection section 311A connected to the second heating element Hb is configured to be less than the volume of the second connection section 321A connected to the second heating element Hb. The volume of the first connection section 311A connected to the first heating element Ha is configured to be substantially the same as the volume of the second connection section 321A connected to the second heating element Hb. The volume of the second connection section 321A connected to the first heating element Ha is substantially the same as the volume of the first connection section 311A connected to the second heating element Hb.

In the thermal head X2, the specific heat of the first electrode 31A is substantially the same as the specific heat of the second electrode 32A. The volume of the first connection section 311A connected to the first heating element Ha is more than the volume of the second connection section 321A connected to the first heating element Ha. In the thermal head X2, the volume of the first connection section 311A connected to the second heating element Hb is less than the volume of the second connection section 321A connected to the second heating element Hb. Therefore, when a large amount of heat is accumulated in proximity to each of the heating elements H, for example, when continuously applying current, the thermal head X2 can use a difference of the amounts of transmitted heat between the first connection section 311A and the second connection section 321A so as to displace the position of the heat spot from the position at the initial power-on (near the center of the heating element H). In other words, when a large amount of heat is accumulated in proximity to each of the heating elements H, for example, when continuously applying current, the thermal head X2 can reduce the effect of heat transmitted between the heating elements Ha and Hb adjoining each other. Therefore, the thermal head X2 can reduce unevenness in the amounts of accumulated heat between a central portion and both end portions in a group of heating units constituted by the plurality of heating elements H. Therefore, the thermal head X2 can reduce unevenness in the image between the central portion and the both end portions in the group of heating units.

In the thermal head X2, the area of the first connection section 311A is substantially the same as the area of the second connection section 321A. Therefore, in the thermal head X2, the amount of heat moving from the first connection section 311A to the substrate can be made almost the same as the amount of heat moving from the second connection section 321A to the substrate. Therefore, the thermal head X2 can improve the quality of image.

In the thermal head X2, the volume of the first connection section 311A connected to the first heating element Ha is substantially the same as the volume of the second connection section 321A connected to the second heating element Hb. In the thermal head X2, the volume of the second connection section 321A connected to the first heating element Ha is substantially the same as the volume of the first connection section 311A connected to the second heating element Hb. Therefore, in the thermal head X2, the amount of heat generated by each of the heating elements H and moving to the first electrode 31A can be made almost the same as the amount of heat generated thereby and moving to the second electrode 32A. Therefore, the thermal head X2 can improve the quality of image.

In the thermal head X2, the plan view width $W_{12A}$ of the first conductive section 312A is less than the plan view width $W_{11A}$ of the first connection section 311A. Therefore, even when, for example, the plan view width of the driving IC 60 in the direction of arrow CD is less than the plan view width of an area formed with the first conductive section 312A connected to the driving IC 60, the effect caused by the area in which wirings are located can be reduced.

In the thermal head X2, the plan view width $W_{12A}$ of the first conductive section 312A is less than the plan view width $W_{11A}$ of the first connection section 311A, and the plan view width $W_{22A}$ of the second conductive section 322A is less than the plan view width $W_{21A}$ of the second connection section 321. Therefore, the thermal head X2 can preferably accumulate the heat generated by the heating element H. Further, even when, for example, the plurality of second connection sections 321A are connected to a common connection pattern extending in the main scanning direction, the thermal head X2 can reduce the heat moving via the common connection pattern. Accordingly, even when, for example, the volume of the first connection section 311A is less than the volume of the common connection pattern, the thermal head X2 can preferably displace the position of the heat spot.

In the thermal head X2, a portion of the one end of the first connection section 311A and a portion of the one end of the second connection section 321A are located on the heat accumulation layer 20, and therefore, a less amount of heat generated by the heating element H moves to the substrate 10. Therefore, the thermal head X2 can preferably displace the position of the heat spot.

Figure 6:
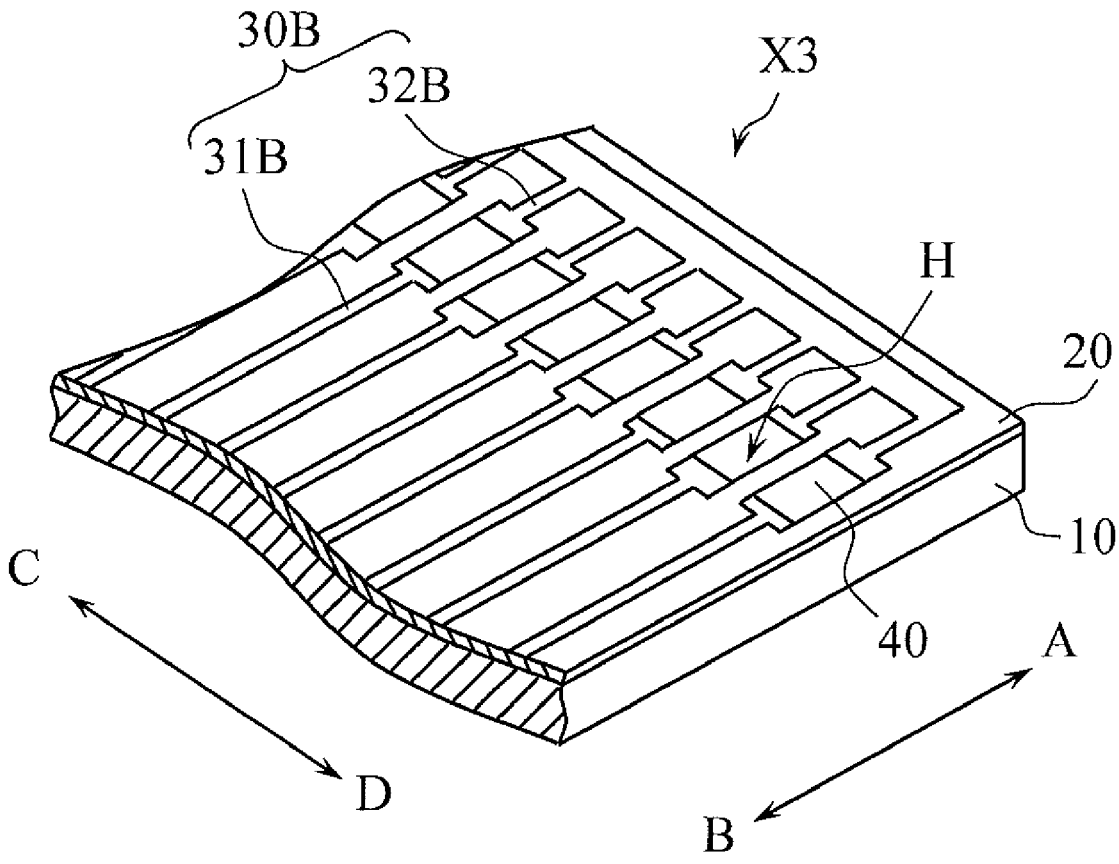
FIG. 6 is an enlarged perspective view illustrating a thermal head according to an embodiment of the present invention.

FIG. 6 is an enlarged perspective view illustrating a thermal head according to an embodiment of the present invention. A thermal head X3 shown in FIG. 6 is different from the thermal head X1 in that a conductive layer 30B is employed instead of the conductive layer 30. The thermal head X3 is configured to be the same as the above-described thermal head X1 except the above difference.

Figure 7:
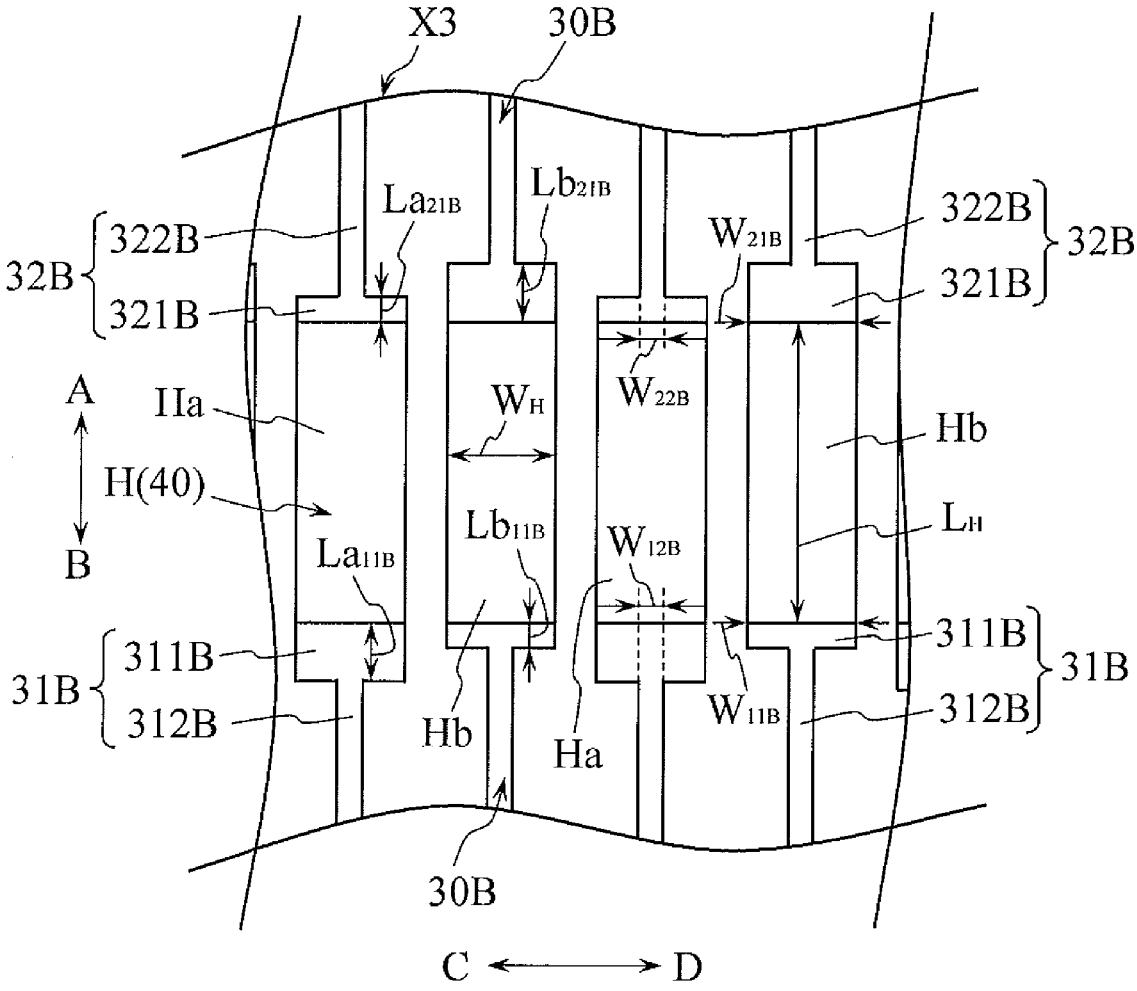
FIG. 7 is an enlarged plan view illustrating a part of the thermal head shown in FIG. 6.

The conductive layer 30B shown in FIG. 7 is different from the conductive layer 30 in that a first electrode 31B is employed instead of the first electrode 31 and a second electrode 32B is employed instead of the second electrode 32. The conductive layer 30B is configured to be the same as the above-described conductive layer 30 except for the above difference.

The first electrode 31B comprises a first connection section 311B and a first conductive section 312B, which are an essential portion. One end of the first connection section 311B is connected to one end of the heating element H indicated by the direction of arrow B, and the other end of the first connection section 311B is connected to one end of the first conductive section 312B. This first connection section 311B is located on the heat accumulation layer 20. The one end of the first conductive section 312B is connected to the other end of the first connection section 311B, and the other end of the first conductive section 312B is connected to the driving IC 60. A portion of the one end of this first conductive section 312B is located on the heat accumulation layer 20.

The second electrode 32B comprises a second connection section 321B and a second conductive section 322B, which are an essential portion. One end of the second connection section 321B is connected to the other end of the heating element H indicated by the direction of arrow A, and the other end of the second connection section 321B is connected to one end of the second conductive section 322B. A plan view width $W_{21B}$ of the one end of this second connection section 321B (a connection end connected to the heating element H) is configured to be substantially the same as a plan view width $W_{11B}$ of the one end of the first connection section 311B (a connection end connected to the heating element H). This second connection section 321B is located on the heat accumulation layer 20. The second conductive section 322B is connected to the other end of the second connection section 321B and the power supply which is not shown. A plan view width $W_{22B}$ of the one end of this second conductive section 322B (a connection end connected to the second connection section 321B) is configured to be the same as a plan view width $W_{12B}$ of the one end of the first conductive section 312B (a connection end connected to the first connection section 311B). The plan view width $W_{22B}$ of this second conductive section 322B is configured to be less than the plan view width $W_{21B}$ of the second connection section 321B. Further, a portion of the one end of this second conductive section 322B is located on the heat accumulation layer 20. Herein, "substantially the same" means including those within a generally-occurring manufacturing error, such as one in which an error of each width with respect to the mean value is within a range of 10 [%].

In the present embodiment, a specific heat of a material constituting the first electrode 31B is substantially the same as a specific heat of a material constituting the second electrode 32B. The material constituting the first electrode 31B is preferably the same as the material constituting the second electrode 32B, because the amount of heat generated by each of the heating elements H and moving to the first electrode 31B is made to be the same as the amount of heat generated thereby and moving to the second electrode 32B. The thermal head X3 configured as described above can improve image quality. Further, in the thermal head X3 configured as described above, for example, the first electrode 31B and the second electrode 32B can be formed in the same step, and accordingly, the efficiency in the manufacture can be improved. Herein, "specific heat" means constant volume specific heat. This "constant volume specific heat" means the amount of heat needed to change the temperature of a substance per unit quantity by a unit temperature where the substance is kept at a constant volume, and is represented by, for example, a unit of [$J/m^3 \cdot K$]. Examples of a method for measuring this "specific heat" comprise differential thermal analysis (DTA) and differential scanning calorimetry (DSC).

In the present embodiment, the thickness of the first connection section 311B and the thickness of the second connection section 321B are configured to be substantially the same throughout the entirety thereof. Therefore, in the present embodiment, the first connection section 311B and the second connection section 321B can be formed in the same step, and accordingly, the efficiency in the manufacture can be improved. Herein, "substantially the same" means including those within a generally-occurring manufacturing error, such as one in which an error of each width with respect to the mean value is within a range of 10 [%].

In the present embodiment, among the plurality of heating elements H, a plan view length $La_{11B}$ of the first connection section 311B connected to the first heating element Ha is configured to be longer than a plan view length $La_{21B}$ of the second connection section 321B connected to the first heating element Ha. A plan view length $Lb_{11B}$ of the first connection section 311B connected to the second heating element Hb is configured to be shorter than a plan view length $Lb_{21B}$ of the second connection section 321B connected to the second heating element Hb. Further, the plan view length $La_{21B}$ is substantially the same as the plan view length $Lb_{11B}$. Also, the plan view length $La_{11B}$ is substantially the same as the plan view length $Lb_{21B}$. Therefore, the area of the first connection section 311B connected to the first heating element Ha is larger than the area of the second connection section 321B connected to the first heating element Ha. The area of the first connection section 311B connected to the second heating element Hb is smaller than the area of the second connection section 321B connected to the second heating element Hb. The area of the first connection section 311B connected to the first heating element Ha is substantially the same as the area of the second connection section 321B connected to the second heating element Hb. The area of the second connection section 321B connected to the first heating element Ha is substantially the same as the area of the first connection section 311B connected to the second heating element Hb.

In the present embodiment, the plan view lengths $La_{11B}$ and $Lb_{11B}$ of the first connection section 311B and the plan view lengths $La_{21B}$ and $Lb_{21B}$ of the second connection section 321B are, for example, within a range between 0 and the plan view length $L_H$ of the heating element H. When the plan view length $La_{11B}$, $La_{21B}$, $Lb_{11B}$ and $Lb_{21B}$ of the connection sections 311B and 321B are configured to be shorter than the plan view length $L_H$ of the heating element H, the differences of the sizes of areas can be preferably configured. The plan view length $La_{11B}$, $La_{21B}$, $Lb_{11B}$ and $Lb_{21B}$ are, for example, within a range between 10 [μm] and 30 [μm] in order to preferably displace the position of the heat spot.

In the thermal head X3, the specific heat of the first electrode 31B is substantially the same as the specific heat of the second electrode 32B. In the thermal head X3, the thickness of the first connection section 311B is substantially the same as the thickness of the second connection section 321B. In the thermal head X3, the area of the first connection section 311B connected to the first heating element Ha is larger than the area of the second connection section 321B connected to the first heating element Ha. In the thermal head X3, the area of the first connection section 311B connected to the second heating element Hb is smaller than the area of the second connection section 321B connected to the second heating element Hb. Therefore, when a large amount of heat is accumulated in proximity to each of the heating elements H, for example, when continuously applying current, the thermal head X3 can use a difference of the amounts of transmitted heat between the first connection section 311B and the second connection section 321B so as to displace the position of the heat spot from the position at the initial power-on (near the center of the heating element H). In other words, when a large amount of heat is accumulated in proximity to each of the heating elements H, for example, when continuously applying current, the thermal head X3 can reduce the effect of heat transmitted between the heating elements Ha and Hb adjoining each other. Therefore, the thermal head X3 can reduce unevenness in the amounts of accumulated heat between a central portion and both end portions in a group of heating units constituted by the plurality of heating elements H. Therefore, the thermal head X3 can reduce unevenness in the image between the central portion and the both end portions of the group of heating units.

In the thermal head X3, the area of the first connection section 311B connected to the first heating element Ha is substantially the same as the area the second connection section 321B connected to the second heating element Hb. In the thermal head X3, the area of the second connection section 321B connected to the first heating element Ha is substantially the same as the area of the first connection section 311B connected to the second heating element Hb. Therefore, in the thermal head X3, the amount of heat generated by each of the heating elements H and moving to the first electrode 31B can be made almost the same as the amount of heat generated thereby and moving to the second electrode 32B. Therefore, the thermal head X3 can improve image quality.

In the thermal head X3, the plan view width $W_{12B}$ of the first conductive section 312B is less than the plan view width $W_{11B}$ of the first connection section 311B. Therefore, even when, for example, the plan view width of the driving IC 60 in the direction of arrow CD is less than the plan view width of an area formed with the first conductive section 312B connected to the driving IC 60, the effect caused by an area in which wirings are located can be reduced.

In the thermal head X3, the plan view width $W_{12B}$ of the first conductive section 312B is less than the plan view width $W_{11B}$ of the first connection section 311B, and the plan view width $W_{22B}$ of the second conductive section 322B is less than the plan view width $W_{21B}$ of the second connection section 321B. Therefore, the thermal head X3 can preferably accumulate the heat generated by the heating element H. Further, even when, for example, the plurality of second connection sections 321B is connected to a common connection pattern extending in the main scanning direction, the thermal head X3 can reduce the heat moving via the common connection pattern. Accordingly, even when, for example, the area of the first connection section 311B is smaller than the area of the common connection pattern, the thermal head X3 can preferably displace the position of the heat spot.

In the thermal head X3, a portion of the one end of the first connection section 311B and a portion of the one end of the second connection section 321B are located on the heat accumulation layer 20, and therefore, a less amount of heat generated by the heating element H moves to the substrate 10. Therefore, the thermal head X3 can preferably displace the position of the heat spot.

Figure 8:
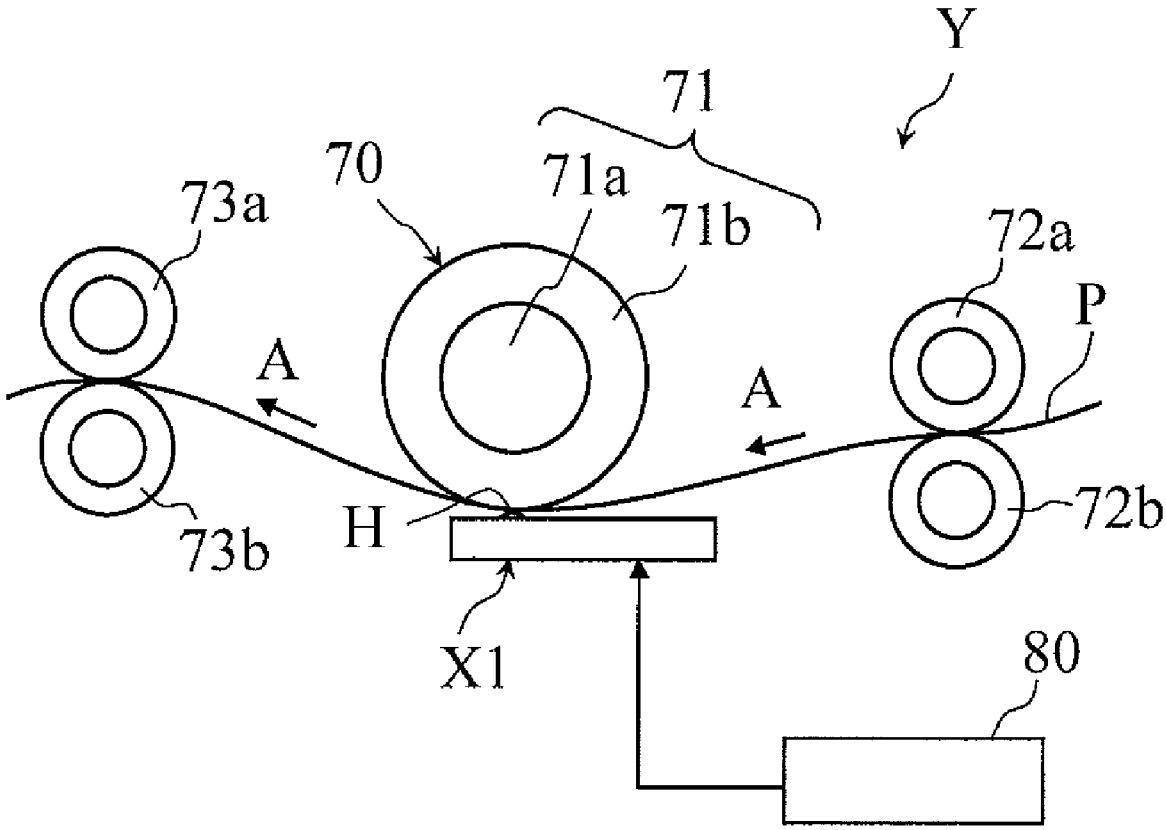
FIG. 8 schematically illustrates a thermal printer comprising the thermal head shown in FIG. 1.

FIG. 8 schematically illustrates a thermal printer comprising the thermal head shown in FIG. 1. A thermal printer Y shown in FIG. 8 comprises the thermal head X1, a conveyance mechanism 70, and driving means 80. The thermal printer Y is configured to print a recording medium P conveyed in a direction of arrow D1. Examples of the recording medium P comprise a heat-sensitive sheet or a heat-sensitive film changing concentration of the surface according to applied heat and a transfer sheet on which an image is formed by transferring ink component of an ink film, which is melted by heat transmission, to the transfer sheet.

The conveyance mechanism 70 is adapted to convey the recording medium P in the sub-scanning direction of the thermal head X1 (direction of arrow A in the figure) while the recording medium P is in contact with the plurality of heating elements H of the thermal head X1. The conveyance mechanism 70 comprises a platen roller 71 and conveyance rollers 72*a*, 72*b*, 73*a* and 73*b*.

The platen roller 71 is adapted to press the recording medium P against the heating element H. The platen roller 71 is supported to be rotatable while the platen roller 71 is in contact with the heating element H. The platen roller 71 according to the present embodiment has such a configuration that an outer surface of a cylindrical base 71*a* is coated by an elastic member 71*b*. The base 71*a* is constituted by, for example, metal such as stainless. The elastic member 71*b* is constituted by, for example, butadiene rubber. The thickness of the elastic member 71*b* is configured to be, for example, within a range between 3 [mm] and 15 [mm].

The conveyance rollers 72*a*, 72*b*, 73*a* and 73*b* are adapted to convey the recording medium P along a predetermined path. In other words, the conveyance rollers 72*a*, 72*b*, 73*a* and 73*b* are adapted to feed the recording medium P to between the heating element H of the thermal head X1 and the platen roller 71, and pull the recording medium P out of between the heating element H of the thermal head X1 and the platen roller 71. The conveyance rollers 72*a*, 72*b*, 73*a* and 73*b* may be formed with cylindrical metal member, or may be configured in the same manner as the platen roller 71.

The driving means 80 is adapted to input a print signal to the driving IC 60. Specifically, the driving means 80 is adapted to provide the print signal for controlling ON/OFF state of a voltage applied to the heating element H via the conductive layer 30.

The thermal printer Y has the thermal head X1, and therefore, can enjoy the effects of the above thermal head X1. Specifically, the thermal printer Y can improve image quality when the amount of accumulated heat is much, for example, when the thermal printer Y is continuously applying current, and can improve the thermal response property when the amount of accumulated heat is less, for example, at the initial power-on. In the present embodiment, the thermal head X1 is employed as the thermal head, but the thermal head X2 or the thermal head X3 may be employed instead of the thermal head X1.

The specific embodiments of the present invention have been hereinabove described. But the present invention is not limited thereto, and may be changed in various way without deviating from the scope of the invention.

Figure 9:
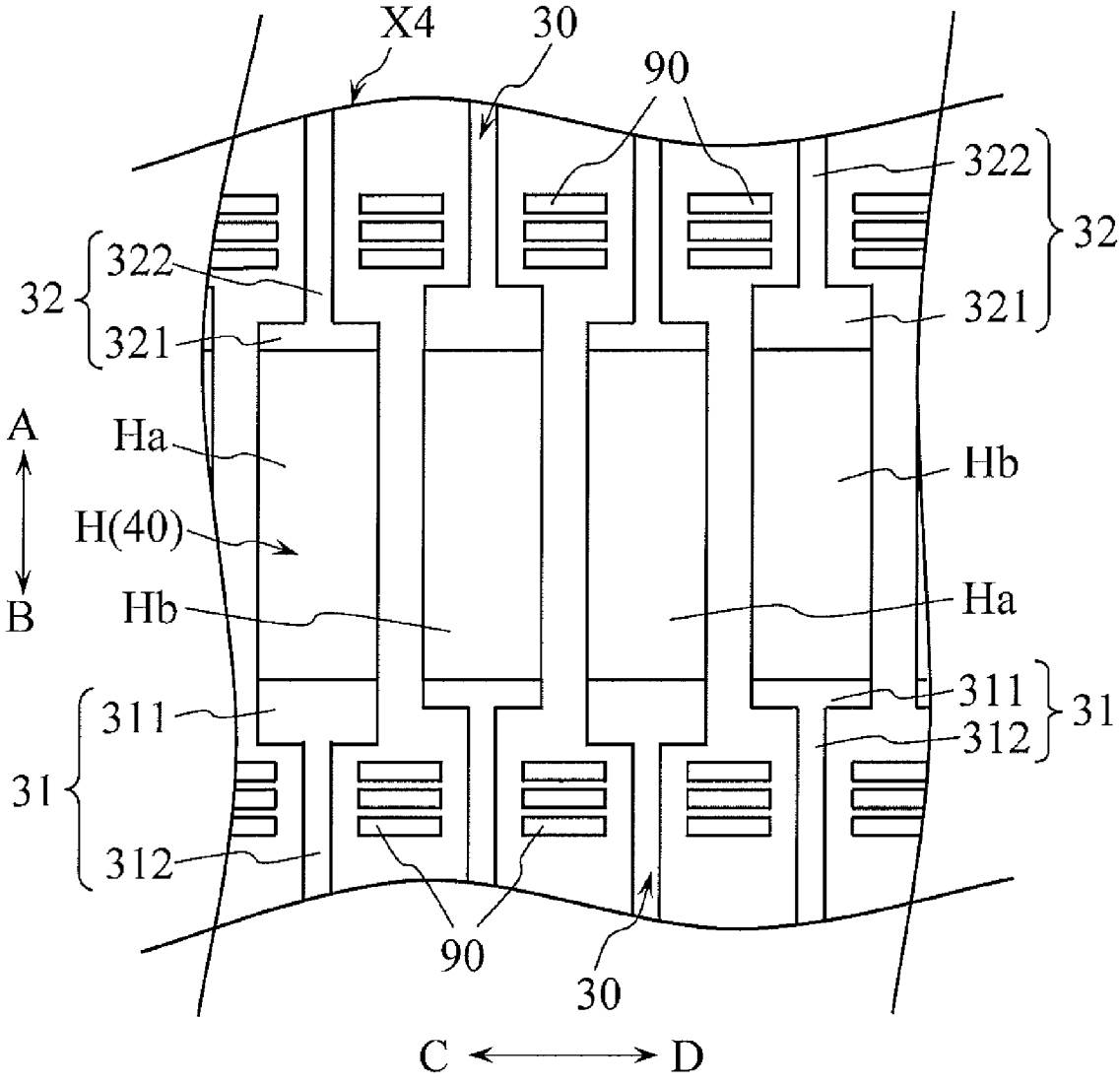
FIG. 9 is an enlarged plan view illustrating a part of a modification of the thermal head shown in FIG. 1.

In the thermal head X1, a dummy conductive layer 90 may be additionally arranged at least one of between the first electrode 31 connected to the first heating element Ha and the first electrode 31 connected to the second heating element Hb and between the second electrode 32 connected to the first heating element Ha and the second electrode 32 connected to the second heating element Hb. An example of the thermal head having such configuration is shown in FIG. 9, in which three dummy electrode layers 90 extending in a direction of arrow CD are respectively formed and arranged in parallel between the first electrode 31 connected to the first heating element Ha and the first electrode 31 connected to the second heating element Hb and between the second electrode 32 connected to the first heating element Ha and the second electrode 32 connected to the second heating element Hb. Such configuration can reduce the contacting area (consequently, frictional force) between the thermal head and the recording medium P conveyed while being in contact with the thermal head. Therefore, with the thermal head having such configuration, sticking of the recording medium P can be alleviated while the recording medium P is conveyed. It should be noted that the dummy electrode layer 90 may be located either one of between the first electrode 31 connected to the first heating element Ha and the first electrode 31 connected to the second heating element Hb or between the second electrode 32 connected to the first heating element Ha and the second electrode 32 connecting the second heating element Hb. The dummy conductive layers 90 are preferably located at both of them in terms of suppressing sticking.

In the thermal head X1, the heat accumulation layer 20 is formed in a flat shape, but the shape is not limited thereto. For example, the thermal head may be configured to comprise, instead of the heat accumulation layer 20 in the flat shape, a protruding heat accumulation layer extending in a substantially belt-like shape in a longitudinal direction of the substrate 10 (direction of arrow CD) and having a substantially arc-shaped cross section taken in a direction perpendicular to the longitudinal direction and an accumulation layer having both of a protruding section and a flat section. With such configuration having a protruding shape, a heat accumulation property for accumulating heat generated in the heating element H can be improved by, for example, forming the plurality of heating elements H in the protruding section of the heat accumulation layer.

In the thermal head X1, the plan view widths $W_{12}$ and $W_{22}$ of the first conductive section 312 and the second conductive section 322 of the conductive layer 30 are configured to be substantially the same size, but the configuration is not limited thereto. Alternatively, in the thermal head X1, a plan view width of one of conductive sections may be larger than a plan view width of the other of conductive sections. In such case, one of the first conductive section 311 and the second connection section 321 connected to one heating element H and connected to a connection section having a larger heat capacity may be configured to have a larger plan view width than the plan view width of the other conductive section, or may be configured to be thicker than the other conductive section, so that the position of the heat spot can be adjusted preferably.

In the thermal head X1, the resistive layer 40 may be configured to have substantially the same thickness throughout the entirety thereof, but the configuration is not limited thereto. For example, the plan view width, the plan view length, and the like may be adjusted, as necessary, in accordance with the thickness of the resistive layer 40 so that the resistive layer 40 has substantially the same cross sectional area taken in the direction of arrow CD at any place between the connection end of the heating element H connected to the first connection section 311 and the connection end of the heating element H connected to the second connection section 312.

Figure 10:
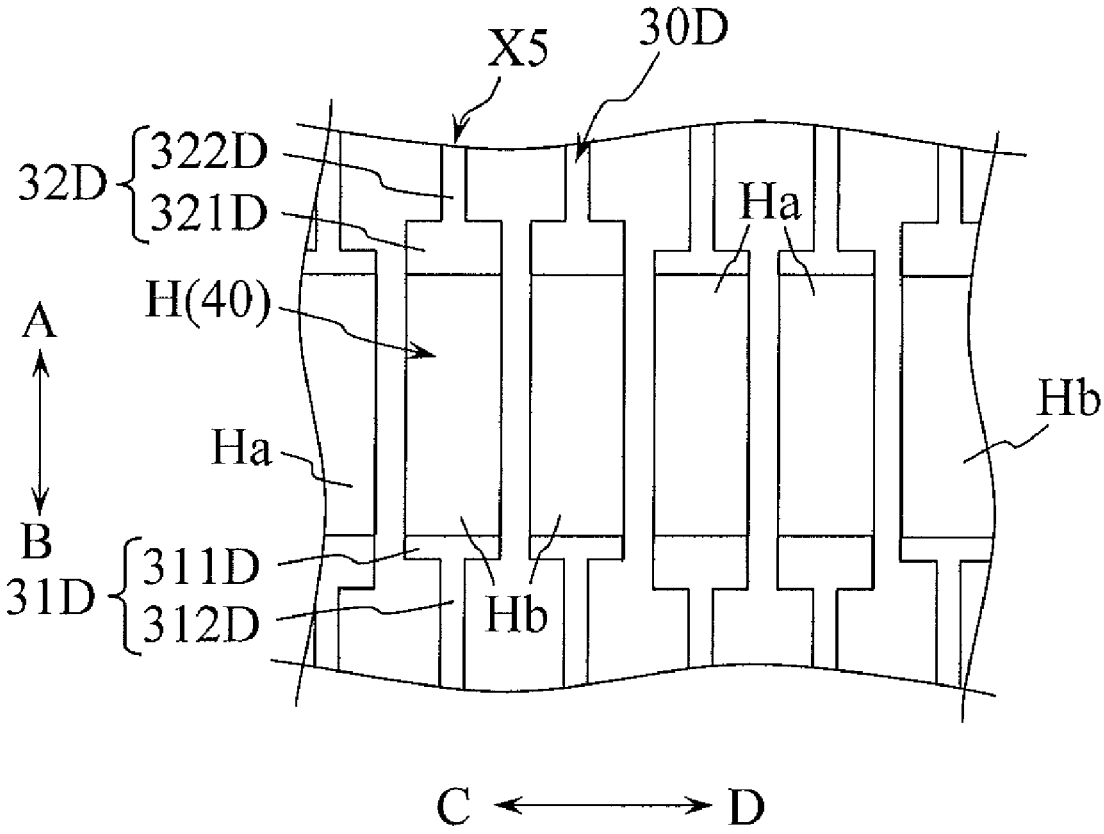
FIG. 10 is an enlarged plan view illustrating a part of a modification of the thermal head shown in FIG. 1.
Figure 11:
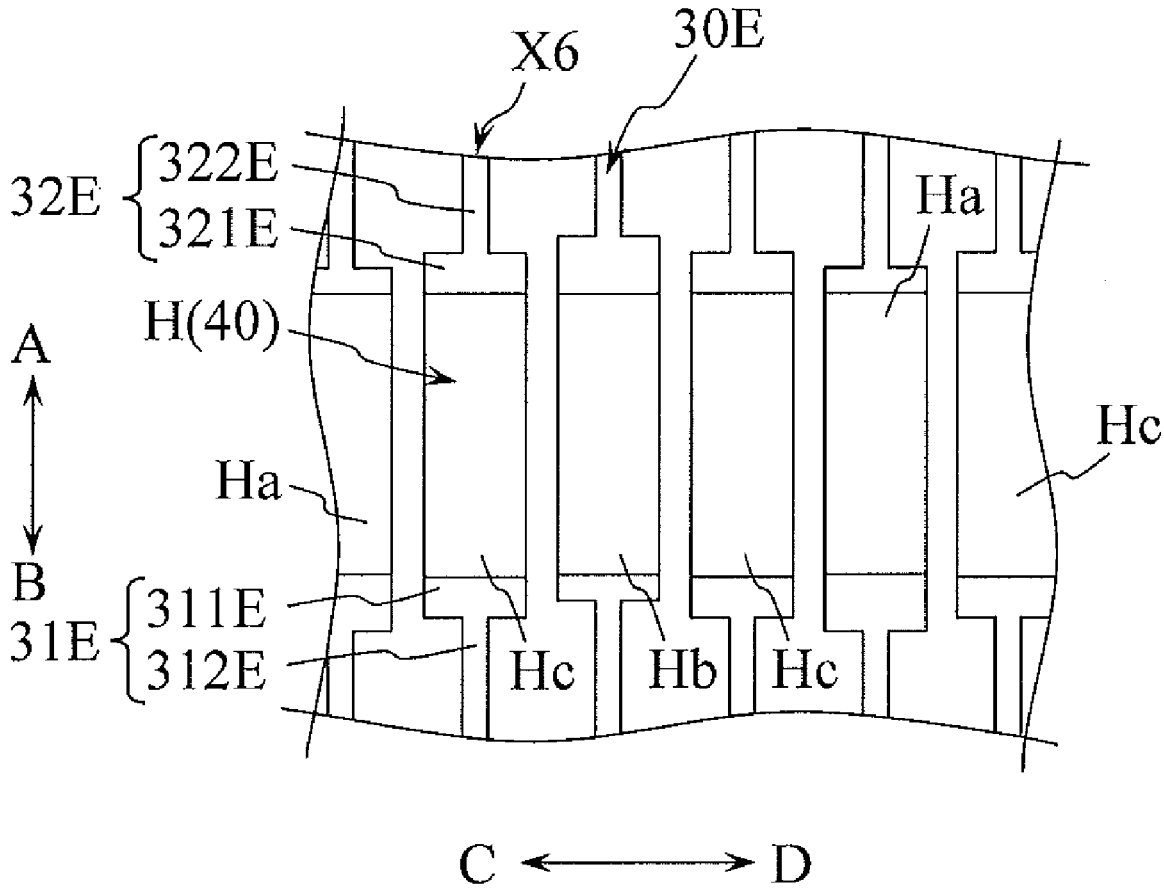
FIG. 11 is an enlarged plan view illustrating a part of a modification of the thermal head shown in FIG. 1.

In the thermal head X1, the first heating element Ha and the second heating element Hb are alternately arranged, but the arrangement is not limited thereto. The first heating element Ha and the second heating element Hb may be arranged in a cycle at some of the plurality of heating elements H. For example, as shown in FIG. 10, the first heating element Ha and the second heating element Hb may be arranged alternately at every two heating elements H. Alternatively, for example, as shown in FIG. 11, a third heating element Hc may be located between the first heating element Ha and the second heating element Hb, and a first connection section 311E and a second connection section 321E having the same plan view width may be connected to the third heating element Hc.

Figure 12:
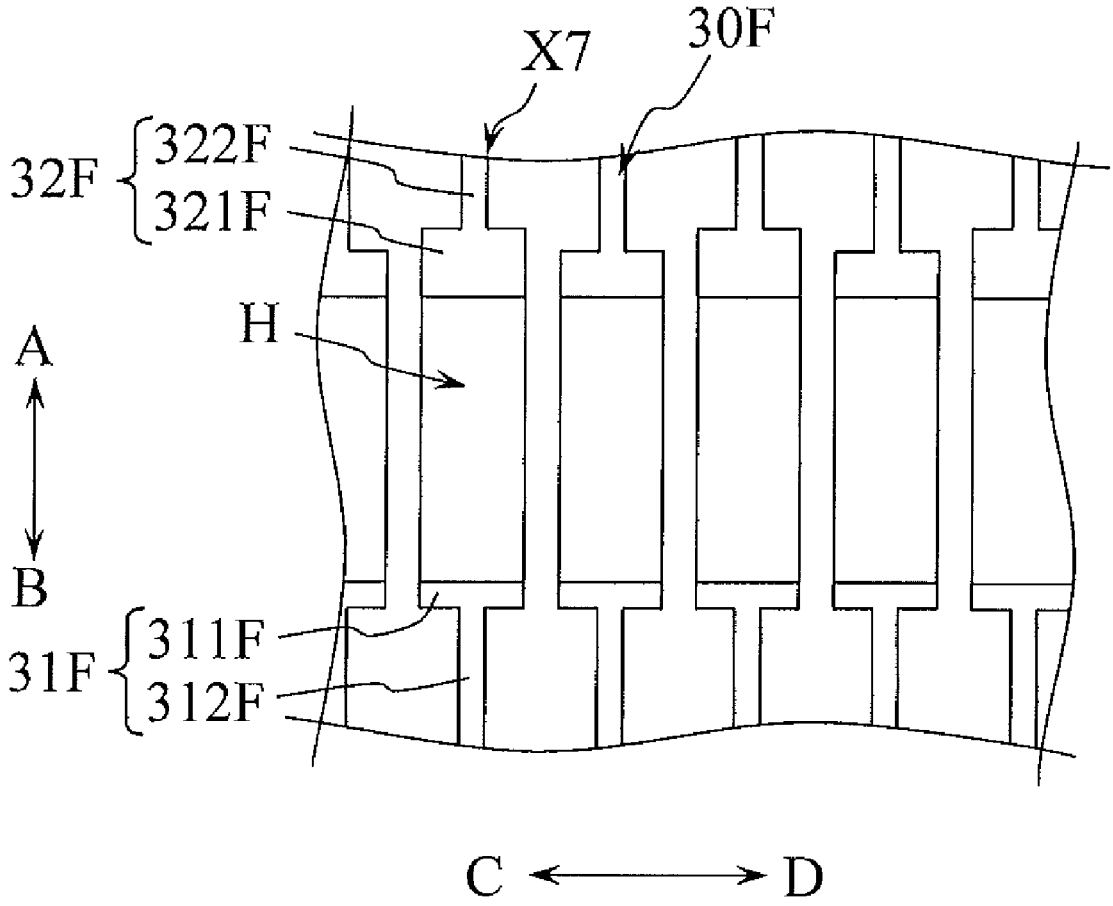
FIG. 12 is an enlarged plan view illustrating a part of a modification of the thermal head shown in FIG. 1.

In the thermal head X1, the first connection section 311 and the second connection section 321 are configured to have different thermal capacities depending on whether the respective thermal capacities are connected to the first heating element Ha or the second heating element Hb, but the configuration is not limited thereto. At least one of the first connection section 311 and the second connection section 321 connected to the heating elements H adjoining each other may have a different heat capacity. With such configuration, the positions of the heat spots of the adjoining heating elements H can be displaced. For example, as shown in FIG. 12, a first connection sections 311F may be configured to have the same plan view width, and a second connection sections 321F having different plan view widths may be alternately arranged. Further, in a thermal head X7 as shown in FIG. 12, the plan view length of the second connection section 321F is configured to be longer than the plan view length of the first connection section 311F. With such configuration, the heat capacity of the first connection section 311F can be made larger than the heat capacity of the second connection section 321F. Therefore, in the thermal head X7, the position of the heat spot is displaced from the center of the heating element H toward an upstream side in a conveyance direction (toward the direction of arrow B). Therefore, in the thermal head X5, for example, a platen roller 71 can exert the strongest force in the central portion of the heating element H, and even when an ink film and a transfer sheet are used as the recording medium, ink component can be melted and transferred to a transfer sheet.

Figure 13:
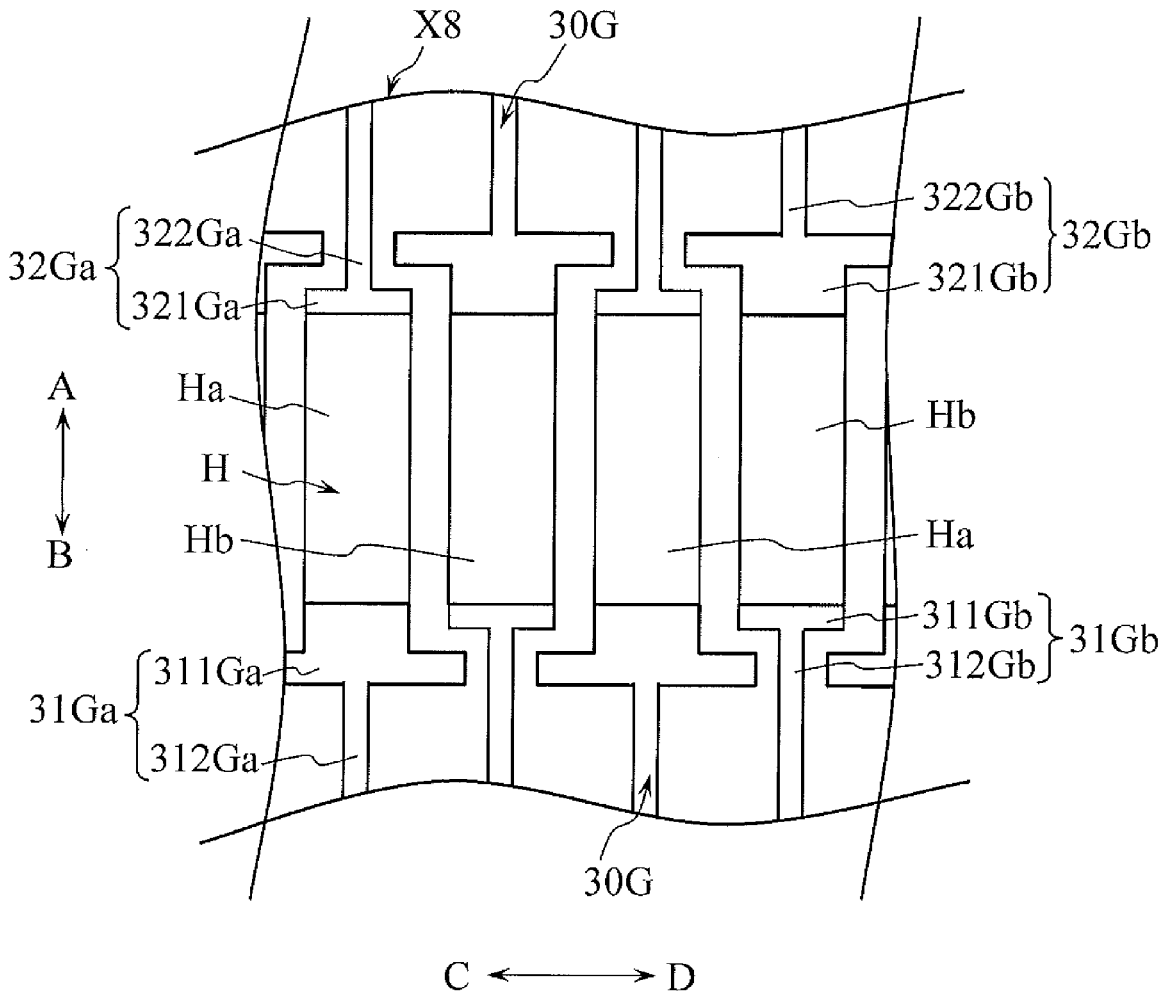
FIG. 13 is an enlarged plan view illustrating a part of a modification of the thermal head shown in FIG. 1.

In the thermal head X1, both ends of the first connection section 311 and the second connection section 321 in the main scanning direction are configured to be located along the sub-scanning direction, but the configuration is not limited thereto. For example, as shown in FIG. 13, a first connection section 311Ga connected to the first heating element Ha may have a protruding section protruding toward a first connection section 311Gb connected to the second heating element Hb. Further, for example, as shown in FIG. 13, the second connection section 321Ga connected to the first heating element Ha may have a protruding section protruding toward the second connection section 321Gb connected to the second heating element Hb. Such configuration can reduce the contacting area (consequently, frictional force) between a thermal head X8 and the recording medium P conveyed while being in contact with the thermal head X8. Therefore, with the thermal head X8 having such configuration, sticking of the recording medium P can be alleviated while the recording medium P is conveyed. The protruding section may be located at one of the first connection section 311Ga connected to the first heating element Ha and the second connection section 321Ga connected to the first heating element Ha. But the protruding section is preferably located at both of them in terms of suppressing sticking.

In the thermal head X1, the first connection section 311 and the first conductive section 312 are configured to be directly connected with each other, and the second connection section 321 and the second conductive section 312 are configured to be directly connected with each other, but the configuration is not limited thereto. For example, a transition unit changing a heat capacity may be located at least one of between the first connection section 311 and the first conductive section 312 and between the second connection section 321 and the second conductive section 312. In such configuration, a portion of the transition unit having a cross sectional area, taken in the direction of arrow CD, one-half of the cross sectional area, taken in the direction of arrow CD, of the connection section connected thereto is deemed to be a connection section.

In the above modifications, the thermal head X1 is employed as the thermal head, but the thermal head X2 or the thermal head X3 may be employed instead of the thermal head X1.

In the thermal head X2, the first connection section 311A and the second connection section 321A of the conductive layer 30A are configured to have the same area, but the configuration is not limited thereto. For example, the plan view width, the plan view length, and the thickness may be adjusted, as necessary, in accordance with the thickness so that the first connection section connected to the first heating element Ha has a larger volume than the second connection section connected to the first heating element Ha, and the first connection section connected to the second heating element Hb has a smaller volume than the second connection section connected to the second heating element Hb.

In the present embodiment, the thermal head X1 is used as the recording head in the explanation. The same effects can be achieved, when the same configurations are employed in, for example, an inkjet printer. Specifically, when a large amount of heat is accumulated, for example, when the recording head is continuously energized, image quality is improved, and when a small amount of heat is accumulated, for example, at the initial power-on, a thermal response property can be improved.

The invention claimed is:

1. A recording head comprising:

a substrate;

a first heating element on the substrate comprising a first end and a second end;

a second heating element on the substrate comprising a third end and a fourth end, and adjacent to and in parallel to the first heating element;

a first connection section on the substrate connected to the first end;

a second connection section on the substrate connected to the second end, wherein the first heating element, the first connection section and the second connection section lie in a straight line;

a third connection section on the substrate connected to the third end; and a fourth connection section on the substrate connected to the fourth end, wherein the second heating element, the third connection section and the fourth connection section lie in a straight line, and wherein the first connection section has a larger heat capacity than the second connection section, and the third connection section has a smaller heat capacity than the fourth connection section.

2. The recording head according to claim 1, wherein the first connection section, the second connection section, the third connection section and the fourth connection section have the same thickness.

3. The recording head according to claim 1, wherein the first connection section and the first heating element have the same width, and the fourth connection section and the second heating element have the same width.

4. The recording head according to claim 1, wherein the first end of the first heating element and the third end of the second heating element are aligned and the second end of the first heating element and the fourth end of the second heating element are aligned.

5. A recording apparatus comprising:

a recording head according to claim 1; and a conveyance unit configured to convey a recording medium above the recording head.

6. A recording head comprising:

a substrate;

a first heating element on the substrate comprising a first end and a second end;

a second heating element on the substrate comprising a third end and a fourth end, and adjacent to and in parallel to the first heating element;

a first connection section on the substrate connected to the first end;

a second connection section on the substrate connected to the second end, wherein the first heating element, the first connection section and the second connection section lie in a straight line;

a third connection section on the substrate connected to the third end; and a fourth connection section on the substrate connected to the fourth end, wherein the second heating element, the third connection section and the fourth connection section lie in a straight line, and the first connection section has a different heat capacity from the third connection section and/or the second connection section has a different heat capacity from the fourth connection section, and wherein the first connection section has substantially the same heat capacity as the fourth connection section and/or the second connection section has substantially the same heat capacity as the third connection section.

7. A recording head comprising:

a substrate;

a first heating element on the substrate comprising a first end and a second end;

a second heating element on the substrate comprising a third end and a fourth end, and adjacent to and in parallel to the first heating element;

a first connection section on the substrate connected to the first end;

a second connection section on the substrate connected to the second end, wherein the first heating element, the first connection section and the second connection section lie in a straight line;

a third connection section on the substrate connected to the third end; and a fourth connection section on the substrate connected to the fourth end, wherein the second heating element, the third connection section and the fourth connection section lie in a straight line, and wherein the first connection section has a larger heat capacity than the second connection section, and the third connection section has a smaller heat capacity than the fourth connection section, that further comprises:

a first lead connected to the first connection section, and having a smaller cross sectional area taken along a direction perpendicular to the straight line than the first connection section; and a second lead connected to the second connection section, and having a smaller cross sectional area taken along a direction perpendicular to the straight line than the second connection section, and a third lead connected to the third connection section, and having a smaller cross sectional area taken along a direction perpendicular to the straight line than the third connection section; and a fourth lead connected to the fourth connection section, and having a smaller cross sectional area taken along a direction perpendicular to the straight line than the fourth connection section, and wherein the first lead has a larger cross sectional area taken along a direction perpendicular to the straight line than the second lead, and the third lead has a smaller cross sectional area taken along a direction perpendicular to the straight line than the second lead.

8. The recording head according to claim 7, wherein the first lead has a larger cross sectional area taken along a direction perpendicular to the straight line than the second lead, and the third lead has a smaller cross sectional area taken along a direction perpendicular to the straight line than the fourth lead.

9. The recording head according to claim 7, further comprising a dummy conductive layer between the first lead and the third lead and/or between the second lead and the fourth lead.

10. A recording head comprising:

a first heating unit on the substrate, comprising:

a first heating element comprising a first end and a second end;

a first connection section connected to the first end; and a second connection section connected to the second end;

wherein the first heating element, the first connection section and the second connection section lie in a straight line;

a second heating unit on the substrate, adjacent to the first heating element in parallel to the first heating unit, and comprising:

a second heating element comprising a third end and a fourth end:

a third connection section connected to the third end; and a fourth connection section connected to the fourth end;

wherein the second heating element, the third connection section and the fourth connection section lie in a straight line;

wherein the first connection section has a different volume from the third connection section and/or the second connection section has a different volume from the fourth connection section, wherein the first connection section has a larger volume than the second connection section, and the third connection section has a smaller volume than the fourth connection section.

11. The recording head according to claim 10, wherein the first connection section, the second connection section, the third connection section and the fourth connection section have the same thickness.

12. The recording head according to claim 10, wherein the first connection section and the first heating element have the same width, and the fourth connection section and the second heating element have the same width.

13. The recording head according to claim 10, wherein the first end of the first heating element and the third end of the second heating element are aligned and the second end of the first heating element and the fourth end of the second heating element are aligned.

14. A recording apparatus comprising:

a recording head according to claim 10; and a conveyance unit configured to convey a recording medium above the recording head.

15. A recording head comprising:

a first heating unit on the substrate, comprising:

a first heating element comprising a first end and a second end;

a first connection section connected to the first end; and a second connection section connected to the second end;

wherein the first heating element, the first connection section and the second connection section lie in a straight line;

a second heating unit on the substrate, adjacent to the first heating element in parallel to the first heating unit, and comprising:

a second heating element comprising a third end and a fourth end:

a third connection section connected to the third end; and a fourth connection section connected to the fourth end;

wherein the second heating element, the third connection section and the fourth connection section lie in a straight line;

wherein the first connection section has a different volume from the third connection section and/or the second connection section has a different volume from the fourth connection section, wherein the first lead has a larger cross sectional area taken along a direction perpendicular to the straight line than the second lead, and the third lead has a smaller cross sectional area taken along a direction perpendicular to the straight line than the second lead.

16. The recording head according to claim 15, further comprising a dummy conductive layer between the first lead and the third lead and/or between the second lead and the fourth lead.

* * * * *